US005918757A

United States Patent [19]

Przytulla et al.

[11] Patent Number: 5,918,757

[45] Date of Patent: Jul. 6, 1999

[54] PLASTIC BARREL

[75] Inventors: Dietmar Przytulla, Kerpen; Ernst Wurzer, Königswinter, both of Germany

[73] Assignee: Mauser-Werke GmbH, Germany

[21] Appl. No.: 08/984,078

[22] Filed: Dec. 3, 1997

Related U.S. Application Data

[63] Continuation of application No. 08/341,564, filed as application No. PCT/EP93/01185, May 12, 1993, abandoned.

[30] Foreign Application Priority Data

May 15, 1992 [DE] Germany ..... 92 06 651 U

[51] Int. Cl.[6] ..... B65D 17/44

[52] U.S. Cl. ..... 220/288; 220/601; 220/659

[58] Field of Search ..... 220/601, 288, 220/655, 659, 645, 650

[56] References Cited

U.S. PATENT DOCUMENTS 3,825,145 7/1974 Reynolds .

4,674,648 6/1987 Przytulla .

FOREIGN PATENT DOCUMENTS 0 041 874 12/1981 European Pat. Off. .

0 287 966 10/1988 European Pat. Off. .

WO 91/12179 8/1991 WIPO .

*Primary Examiner*—Joseph M. Moy

*Attorney, Agent, or Firm*—Pennie & Edmonds LLP

[57] ABSTRACT

A plastics barrel (10) with a substantially cylindrical barrel wall (12), a disk-shaped barrel floor (14) and a corresponding barrel top (16), in which a closable closure aperture is optionally arranged, and with a circumferential carrying and transporting ring (22), which is arranged on the outer barrel wall (12) in the vicinity of the barrel top (16) and comprises a downward facing horizontal and an inward facing vertical bearing surface (24, 26) for the grab claws of a barrel grab, characterised in that a recessed closure housing (28) with a projecting closure socket (30) is arranged in the centre of the barrel top (16), the internal diameter of the closure socket (30) measuring at least 100 mm or more and this closure socket (30) being closable in a gas-tight and liquid-tight manner by means of a screw lid (32, 34) which can be screwed thereon.

16 Claims, 6 Drawing Sheets

PLASTIC BARREL

This application is a continuation of Ser. No. 08/341,564 filed Feb. 23, 1995 abandoned, which is a 371 of PCT/EP93/0/185 filed May 12, 1993.

FIELD OF THE INVENTION

The invention concerns a plastic barrel having an essentially cylindrical barrel wall, a flat disk shaped barrel bottom and a corresponding barrel cap in which a bunghole opening that can be sealed may be incorporated, and having a circumferential carrying and transport ring, arranged close to the barrel top on the exterior barrel wall, with a horizontally downward-pointing and vertical inward-pointing support surface for the claws of a barrel gripper.

BACKGROUND OF THE INVENTION

Conventional bung barrels with conventional bunghole openings are only suitable for the storage and transport of liquids; due to the small bunghole opening (2 inches), bung barrels are not suitable for viscous or particulate shape goods. Due to the required accessories (large lid and clamping ring), the lid-type drums normally used for the storage and transport of viscous or solid goods, such as bitumen, paint, fruit concentrate, granulates, bulk goods and the like, are comparatively expensive, in particular for simple applications, such as the transport of granular products like plastic pellets (e.g. EFS=Expandable Polystyrene), and they have worse dropping characteristics than closed bung barrels.

SUMMARY OF THE INVENTION

It is the task of the present invention to indicate a plastic barrel which is particularly suitable for the transport of viscous or granular products.

It must be possible to produce the barrel at low cost, and it must be possible to handle it by means of the usual barrel gripping tools.

According to the invention, this task is solved by arranging a recessed bung housing with a bunghole neck centered in the barrel cover of a generic plastic barrel, the bunghole neck diameter being at least 100 mm or more. A preferred design provides for a bunghole neck diameter of approx. 150 mm. In another special design, the diameter of the bunghole neck is approx. 225 mm. It is of advantage that only these diameters are used for the various barrel sizes (e.g. 120 1, 220 1) uniformly. The L-ring barrel according to the invention, which has a centered screw-cap, can be produced at lower cost compared to a normal standard cover barrel, and it has better dropping characteristics than the latter. Compared to the large barrel cover, the screw-type barrel caps can also be made at lower cost (since they are only offered in two sizes), and the cost for an additional clamping ring is also eliminated. Therefore, it is possible to offer low-cost screw-cap barrels both for the above-mentioned application with particulate products and granulates, respectively, and for filling in lumpy foodstuff or viscous fruit concentrates with lumps of fruit. Compared to lid-type drums, there are additional advantages since the screw-cap barrels according to the invention, having the top carrying and transport ring (Mauser L-ring), can be handled and manipulated by means of the same barrel gripping tools as those for normal bung barrels of steel or plastic.

In the preferred design, the complete barrel is blow-molded in one piece. Naturally, the barrel can be welded together from two (or three) parts, such as a separately injection-moldedtop (and possibly a molded bottom) and an extruded cylindrical basic barrel body.

In addition, the barrel according to the invention may also be fitted with a circumferential, stable floor rolling ring at the bottom barrel edge, at the transition between the exterior barrel wall and the flat barrel bottom.

It is an important feature of the invention that, regardless of the capacity of the L-ring barrels (e.g. 60 1, 120 1, 150 1, 160 1 or even 220 1), the dimensions of the two preferred sizes of th e screw-cap cover are retained. The smaller version of the screw-cap has an outside diameter of approx. 180 mm while the outside diameter of the larger screw-cap is approx., 270 mm.

In the present case, the bunghole neck has an outside thread for the screw-cap which according to the invention has an inside thread; whereas the usual, small 2-inch bunghole necks of normal bung barrels always have inside threading and the appertaining bung plug has a corresponding outside thread.

An expanded concept of the invention provides for the upper plane of the screw-cap, which is screwed onto the bunghole neck, to be arranged at the same height or almost flush with the barrel top or below the barrel top.

Hence, the screw-cap recessed in the center of the barrel top in a bung depression has optimum protection in the event that the barrel is dropped and will never have direct floor contact.

BRIEF DESCRIPTION OF THE DRAWINGS

Below, the invention is explained and described by means of the design examples presented schematically in the drawings.

DETAILED DESCRIPTION OF THE INVENTION

Figure 1:
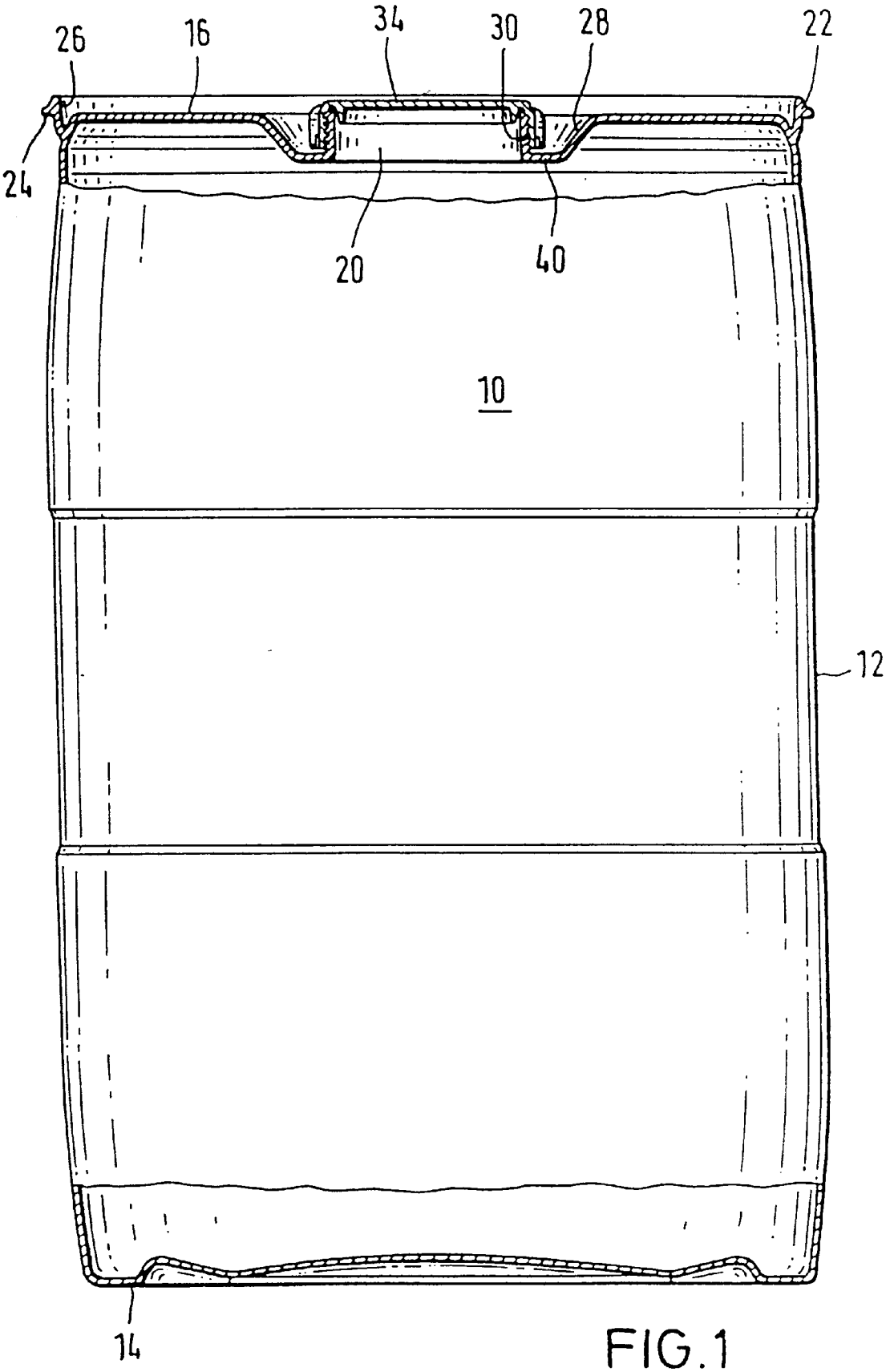
FIG. 1 shows a screw-cap barrel according to the invention in a side view, partly as sectional view.

In FIG. 1, reference number 10 designates a plastic barrel according to the invention (HOT barrel), having a cylindrical barrel wall 12, a disk shape barrel bottom 14 and a corresponding barrel top 16. In the transition area between the barrel top 16 and the outer barrel wall 12, a circumferential carrying and transport ring 22 with a horizontal downward-pointing support surface 24 and a vertical inward-pointing counter-support surface 26 for the gripping claws of a commercial barrel gripper for steel drums is provided.

Centered in the barrel top 16, a recessed bung housing 28 with a bunghole neck 30, which protrudes from the level bung housing floor 40, and is provided with an outside thread. The inside diameter of the bunghole neck 30 and of the bunghole opening 20 (18), respectively, is at least 100 mm or more (larger) and is closed gas-and liquid-tight by means of a screwed-on screw-type cap 34 (32) having the corresponding inside thread at the edge of the flange.

The smallest inside diameter of the bunghole neck should not be below 100 mm, because the opening should at least be large enough that one is able to pass one's hand through it. Of course, this minimum opening is very advantageous for complete inside cleaning of the barrel if it is used several times. On the other hand, the bunghole opening should not be significantly larger than half the barrel diameter; in that case, the cost advantage would be lost and the drop resistance may be decreased, for example because strong elastic deformation of the top may cause leakage of the screw-cap.

Figure 2:
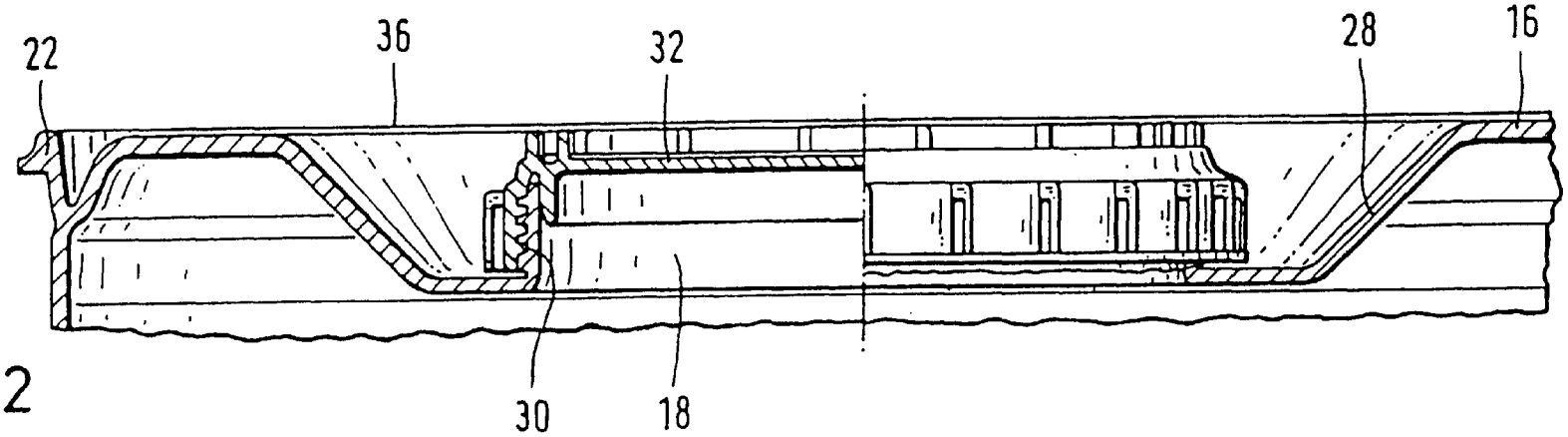
FIG. 2 shows the top edge area of a barrel with the large screw-cap.

In FIG. 2, the top part of the barrel with the larger bunghole opening 18 is shown, where the bung neck 30 has an inside diameter of approx. 225 mm. Measured in the upper plane of the barrel top, the diameter of the bung housing is between 300 mm and 400 mm, preferably approx. 330 mm, and the diameter of the level bung housing floor is between 250 mm and 330 mm, preferably approx. 270 mm. The larger screw-cap 32, having an outside diameter of approx. 270 mm, may be provided on its surface with projecting circumferential ribs permitting the use of a wrench.

Figure 3:
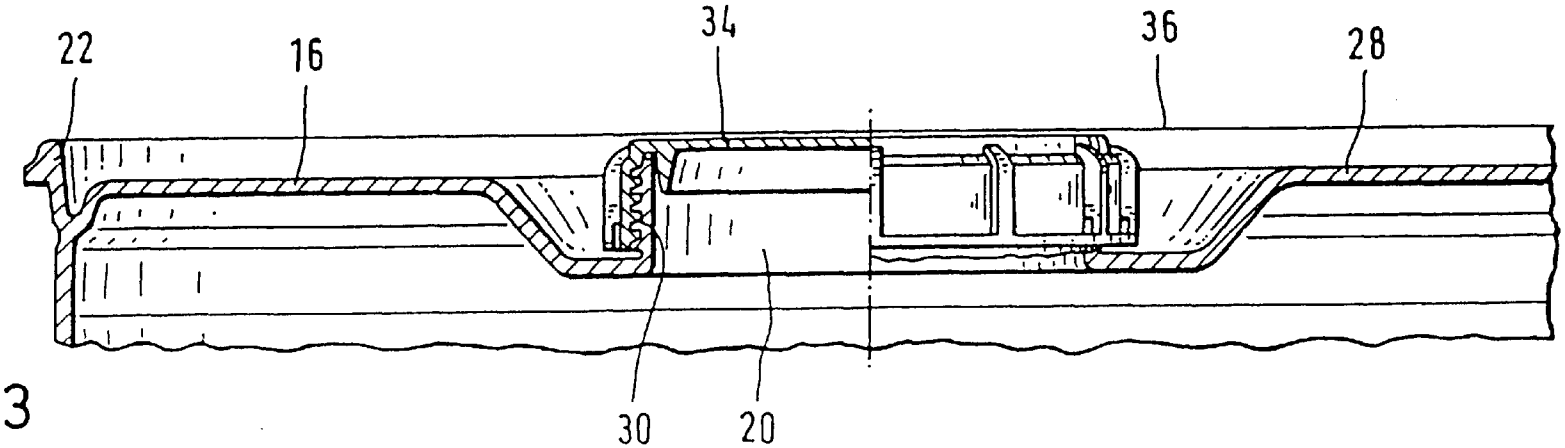
FIG. 3 shows the top edge area of a barrel with the small screw-cap.

The other, preferred design with the smaller bunghole opening 20, having an inside diameter of the bung neck 30 of approx. 150 mm, is shown in FIG. 3. In this case, the diameter of the bung housing, measured at the upper plane of the barrel top, is between 200 and 300 mm, preferably approx. 230 mm, and the diameter of the level bung housing floor is between 180 mm and 250 mm, preferably approx. 190 mm. The smaller screw-cap 34, having an outside diameter of approx. 180 mm, preferably has a level surface. The flat, disk-shaped surface of the screw-cap is connected to a flange edge having a height of approx. 40 mm. and extending at a right angle. The outside of the flange edge is filleted or knurled for improved manual grip when the cover is screwed on. The flange edge has an inside thread, and the bunghole neck 30 has a corresponding outside thread. At a small distance from the flange edge, a second flange ring, which is a little shorter, is provided which also extends at a right angle. There is a circumferential U-shape groove between the outer and the inner flange edge. Into this groove a gasket is inserted to seal the screw cover against the upper face edge of the bunghole neck 30.

In this design, the upper plane of the screw-cap, which is screwed onto the bunghole neck, extends between the upper plane of the barrel top and the upper plane of the upper face edge of the carrying and transport ring 22.

In a design, which is not drawn in detail, the upper plane of the barrel top lies above the upper plane of the face edge of the carrying and transport ring.

In this case, a supporting internal pressure is built up in the lower barrel which is advantageous when barrels of the same type are stacked, before the stack load is transferred to the carrying and transport ring.

Figure 4:
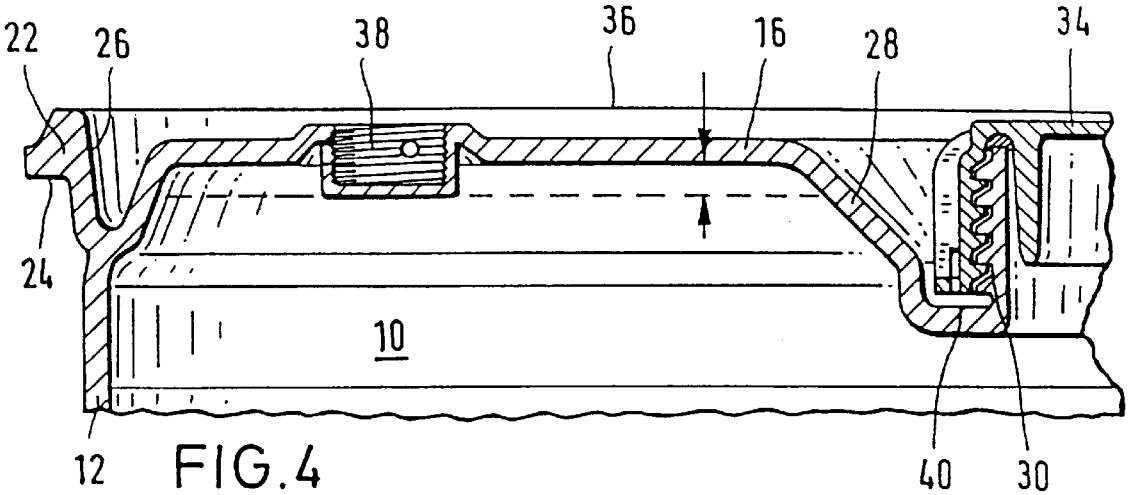
FIG. 4 shows the top edge area of a barrel with the small screw-cap and additional bunghole for complete draining.

In FIG. 4, another design according to the invention is shown in a partial section, where the barrel top 16, in addition to the large-drawer screw-cap opening (18, 20), is provided with a second, small bunghole opening 38, which can be closed, to the side of the former for completely emptying the barrel contents. It is useful that this bunghole opening 38 remains initially closed at the bottom (inside) in the blow molding process. Only when required, lateral bores can be drilled in the threaded neck, or the disk-shaped bottom of the threaded neck is cut out. The bunghole opening 38 can be closed by a suitable conventional bung plug. In the design shown, the upper plane of the barrel top 16 is arranged below the top edge 36 of the carrying and transport ring 22, while the screw-cap 34 projects a little beyond the barrel top 16.

This design effects a central support and a circumferential support of stacked barrels of the same type.

However, in a variation of the design, the face edge 36 of the carrying and support ring 22, the barrel top 16 and the screw-cap 32, 34 on the bunghole neck 30 may also be arranged in essentially the same plane.

Figure 5:
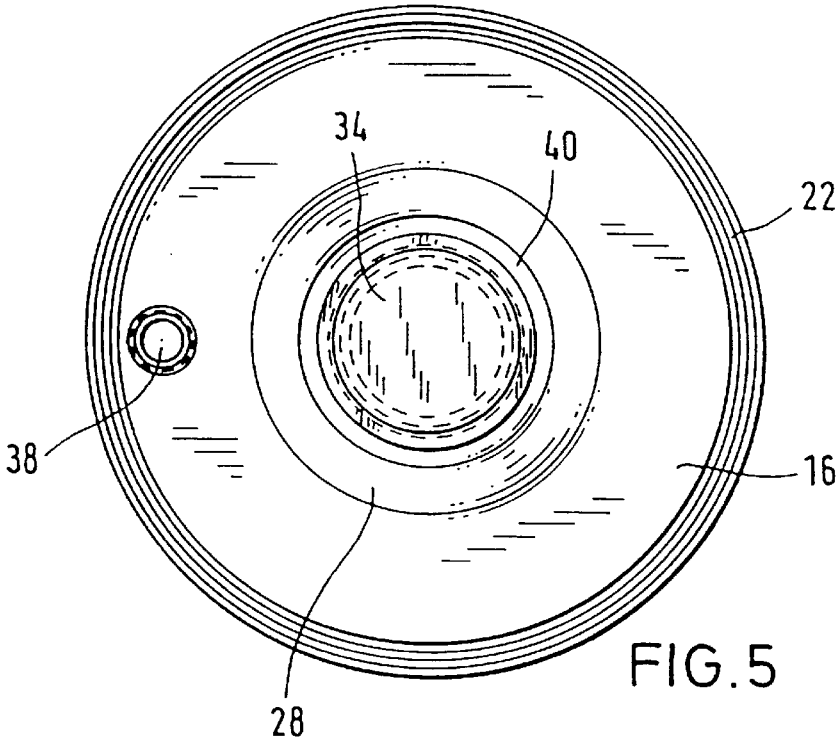
FIG. 5 shows a top view of a screw-cap barrel according to the invention.

FIG. 5 shows a top view of the barrel design according to FIG. 4. The additional bunghole opening 38 may be provided, which need not be the case, however, when used for granular goods, for example.

Figure 6:
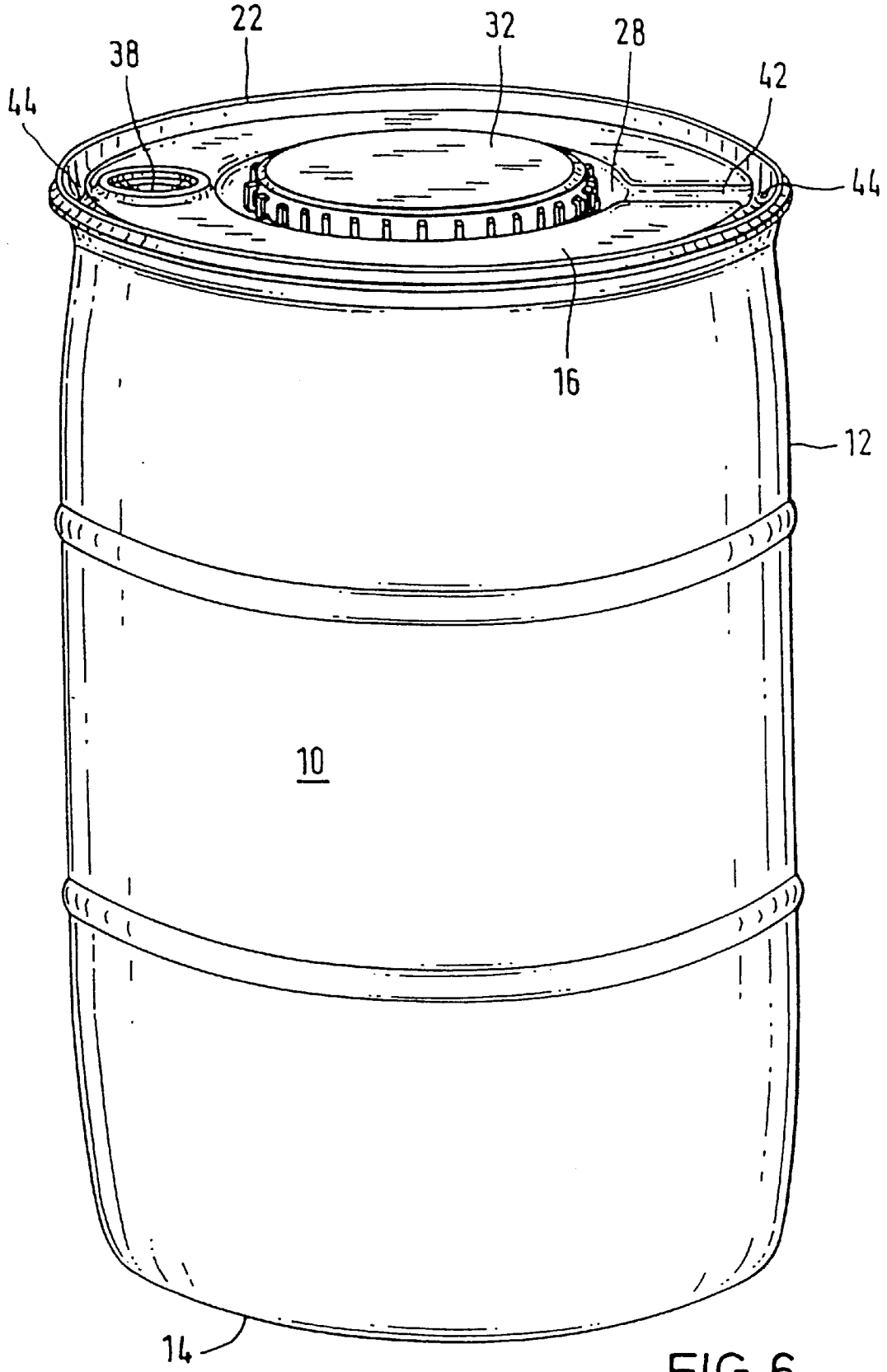
FIG. 6 shows a perspective view of another screw-cap barrel according to the invention.

In a further-developed design—shown in FIG. 6—the barrel top 16 is provided with at least one radial water drain groove 42, which opens into the bung housing 28 on the inside and into the gripping groove 44, which runs behind the carrying and transport ring 22 in the direction of its circumference on the outside.

This prevents, for example, that larger amounts of rain water collect in the bung housing 28 if this type of barrel is stored outside. In this manner, collecting rain water can run off through the groove 42 from the bung housing 28 into the lower gripping groove 44 behind the carrying and transport ring 22. In at least one place, preferably in several places, water drain holes, which open into the bottom of the gripping groove 44, are arranged through the connecting rib of the carrying and transport ring, so that rain water can never collect in the gripping groove 44 itself.

Figure 7:
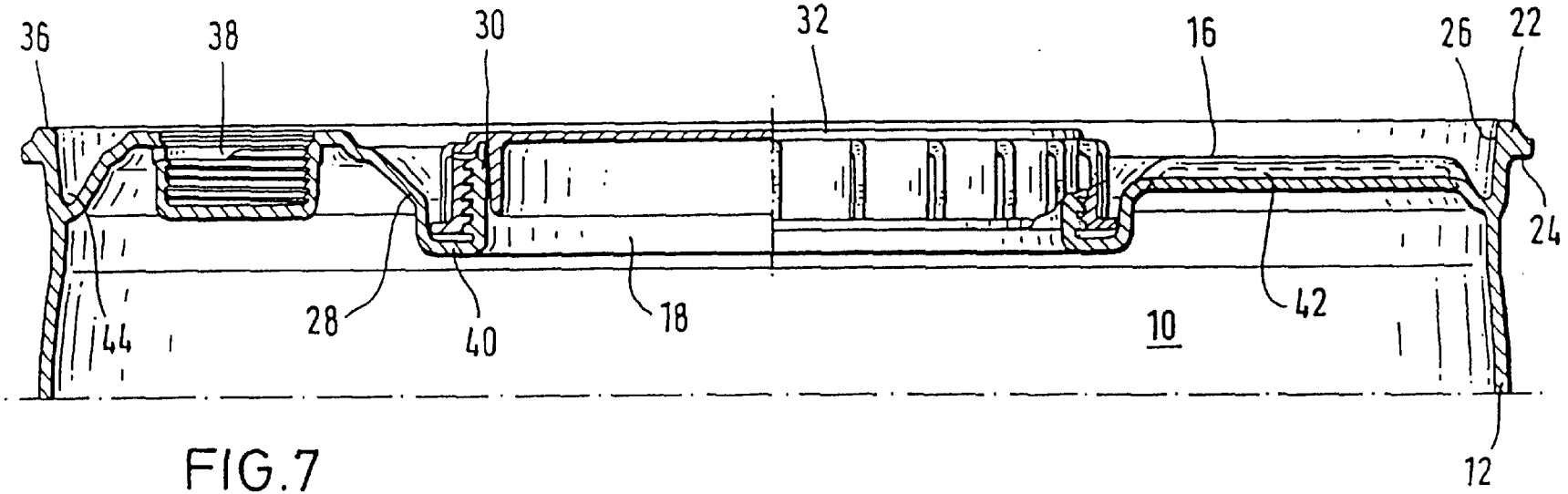
FIG. 7 shows a cross-sectional view of the barrel head of FIG. 6.

In FIG. 7, another feature according to the invention is realized. In order to improve the complete drainage of the barrel in a position inverted by 180', the barrel top has a slight overall slope. Seen in the normal position of the barrel, the side having the additional residual drainage bunghole opening 38 is between 2 mm and 12 mm, preferably about 8 mm, higher than the side opposite the smaller bunghole opening 38.

The height difference of about 8 mm is also indicated in FIG. 4 by means of the dashed height line of the lower barrel top region and the distance arrows pointing at it at right angles. When barrels of this type are stacked, there is central support through the screw-cap 32 and circumferential support through the carrying and transport ring 22 of the bottom barrel.

Figure 8:
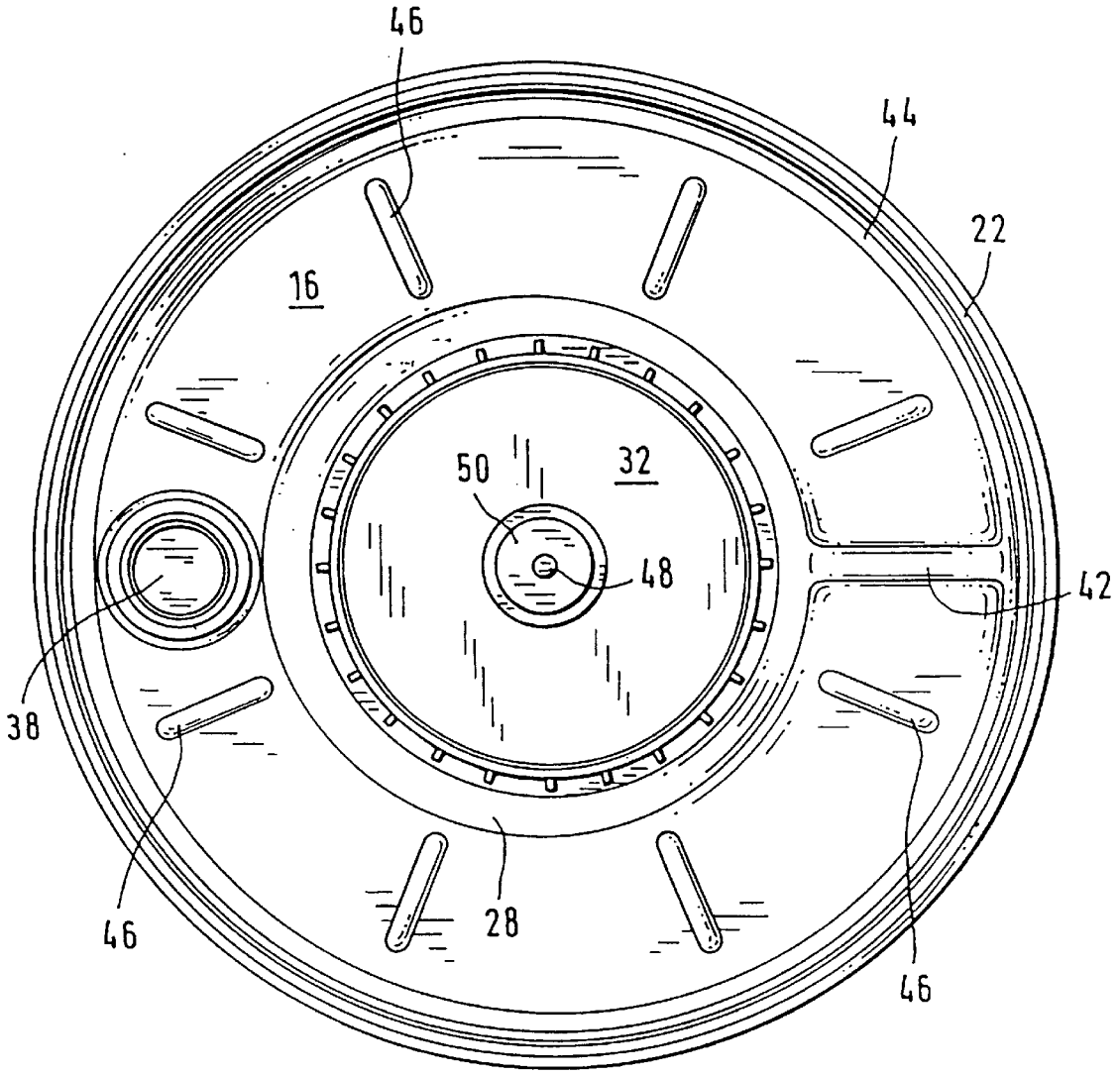
FIG. 8 shows a top view of another design of a screw-cap barrel.

In order to also achieve stack support in the region of the intermediate barrel top, crown elements 46 may be arranged on the surface of the barrel top as shown in FIG. 8, where the top of the crown elements 46 are flush with the carrying and transport ring 22. In the design shown in FIG. 8, eight ribbed crown elements 46 at uniform distances are provided. Naturally, the crown elements may have a different shape, e.g. rectangular or square, and they may be incorporated at the time the barrel is blow-molded, or they may be glued or welded on later as separately made injection-molded parts. It is even simpler to form the entire barrel top with carrying and transport ring, bung neck and crown elements by the injection molding process, whereupon the barrel top is welded onto the basic barrel body.

Hence, the screw cap barrel according to the invention is excellently suited for particle and liquid goods. The large container opening is also advantageous for using an agitator (twirling stick), e.g. with products tending to separate (e.g. zinc oxide paint), which need to be mixed and homogenized before being removed. The barrel is also suitable for multiple use because, in contrast to conventional bung barrels, it may be cleaned inside.

In addition, the large container opening for the first time makes it possible to use without problems a thin-wall plastic inliner for a closed L-ring barrel.

Finally, in order to extend the application of the screw-cap L-ring barrel to the use with goods tending to outgas, the screw cap 32 itself is provided—as indicated in FIG. 8—with a bung plug 50 fitted with a venting device 48, which prevents an overpressure from building up within the barrel.

Generally, the screw-cap L-ring barrel according to the invention may naturally also be equipped with a circumferential floor rolling ring.

We claim:

1. In a plastic barrel (10) of thermoplastic material, having an essentially cylindrical barrel wall (12), with a disk-shaped barrel bottom (14) and a corresponding barrel top (16) having a center and a predetermined diameter, a closable bunghole opening in said barrel top, and a carrying and transport ring (22) with a top edge and horizontal and vertical support surfaces (24, 26), respectively, facing radially inwardly and downwardly, provided near the barrel top (16) on the outside barrel wall for the gripping claws of a barrel gripper, said carrying and transport ring (22) circumferentially surrounding said barrel top (16) and radially spaced therefrom, the improvement comprising:

a) a projecting bunghole opening neck (30), defining the bunghole opening located in the barrel top in alignment with the center of said top and projecting upwardly from said barrel top, said bunghole neck (30) having an external surface with an external thread and an inside diameter of at least 100 mm and no larger than about one-half the diameter of said barrel top; and b) a screw cap (32, 34) with an internal thread removably screwed onto said bunghole neck (30), with the cap having an internal surface in sealing engagement with the external surface of said bunghole neck for closing said bunghole opening in a gas and liquid-tight manner.

2. Plastic barrel according to claim 1, characterized by the fact that the inside diameter of the bunghole neck (30) is approximately 150 mm, and the screw cap has an outside diameter of approximately 180 mm.

3. Plastic barrel according to claim 1, characterized by the fact that the inside diameter of the bunghole neck (30) is approx. 225 mm, and the screw-cap has an outside diameter of approximately 270 mm.

4. Plastic barrel according to claim 2, characterized by the fact that the bunghole housing 28 includes a bung housing floor (40), the diameter of the bung housing (28), measured at the barrel top (16), is between 200 and 300 mm, preferably approximately 230 mm, and the diameter of the bung housing floor (40) is between 180 mm and 250 mm, preferably between 190 mm.

5. Plastic barrel according to claim 3, characterized by the fact that the bunghole housing 28 includes a ban housing floor (40), the diameter of the bung housing (28), measured at the barrel top (16), is between 300 and 400 mm, preferably approximately 330 mm, and the diameter of the bung housing floor (40) is between 250 mm and 330 mm, preferably between 270 mm.

6. Plastic barrel according to claim 1, characterized by the fact that the screw-cap (32), when screwed on to the bunghole neck (30), has an upper surface which is at a level no higher than the barrel top (16).

7. Plastic barrel according to claim 1, characterized by the fact that the screw cover (32), when screwed on to the bunghole neck (30), has an upper surface which is at a level which extends between the barrel top (16) and the top edge (36) of the carrying and transport ring (22).

8. Plastic barrel according to claim 1, characterized by the fact that the barrel top (16) lies above the top edge (36) of the carrying and transport ring (22).

9. Plastic barrel according to claim 1, characterized by the fact that the barrel top (16) lies below the top edge (36) of the carrying and transport ring (22).

10. Plastic barrel according to claim 1, characterized by the fact that the top edge (36) of the carrying and transport ring (22), the barrel top (16) and the screw cap (32, 34) screwed onto the bunghole neck (30) lie in essentially the same plane.

11. Plastic barrel according to claim 1, characterized by the fact that an additional, second small bunghole opening (38) for removing the rest of the barrel content is provided in the barrel top (16).

12. Plastic barrel according to claim 11, characterized by the fact that the barrel top (16) has a slight overall slope when viewed in the normal upright position of the barrel, the side having the additional residual drainage bunghole opening (38) is between 2 mm and 12 mm, preferably about 8 mm, higher than the side opposite the smaller bunghole opening (38).

13. Plastic barrel according to claim 1, characterized by the fact that the barrel top (16) is provided with at least one radial water drain groove (42), which opens into the bung housing (28) on the inside and into a gripping groove (44), which runs behind the carrying and transport ring (22)in the direction of its circumference on the outside.

14. Plastic barrel according to claim 1, characterized by the fact that the barrel top (16) is provided with at least two or more preferably ribbed crown elements (46) at uniform distances.

15. Plastic barrel according to claim 1, characterized by the fact that the lower barrel edge has provisions for a stable circumferential floor rolling ring in the transition area from the outside cylindrical barrel wall (12) and the flat barrel bottom (14).

16. Plastic barrel according to claim 1, wherein the bunghole neck (30) has an upwardly facing edge defining at least part of the external surface which is in engagement with said internal surface of said cap (32,34) to close said bunghole opening in said gas and liquid-tight manner.

* * * * *

UNITED STATES PATENT AND TRADEMARK OFFICE

CERTIFICATE OF CORRECTION

PATENT NO. : 5,918,757

DATED : July 6, 1999

INVENTOR(S) : Przytulla et al.

It is certified that error appears in the above-indentified patent and that said Letters Patent is hereby corrected as shown below:

Column 5, line 60, change "ban" to --bung--.

Column 6, line 43, change "(22)in" to --(22) in--.

Signed and Sealed this

Sixteenth Day of November, 1999

*Attest:*

*Attesting Officer*

Q. TODD DICKINSON

*Acting Commissioner of Patents and Trademarks*